United States Patent [19]

Theurer et al.

[11] 4,249,346

[45] Feb. 10, 1981

[54] MOBILE RAIL GRINDING MACHINE AND METHOD

[75] Inventors: Josef Theurer; Klaus Riessberger, both of Vienna, Austria

[73] Assignee: Franz Plasser Bahnbaumaschinen-Industriegesellschaft m.b.H., Vienna, Austria

[21] Appl. No.: 879,956

[22] Filed: Feb. 21, 1978

[30] Foreign Application Priority Data

Feb. 21, 1977 [AT] Austria ..... 115077
Sep. 7, 1977 [AT] Austria ..... 6443/77

[51] Int. Cl.[3] ..... B24B 23/00
[52] U.S. Cl. ..... 51/178; 51/281 R
[58] Field of Search ..... 51/178, 281 R, 241 LG, 51/175, 258

[56] References Cited

U.S. PATENT DOCUMENTS

| | | | |
|---|---|---|---|
| 976627 | 11/1910 | Boynton | 51/178 |
| 1,031,640 | 7/1912 | Gherky | 51/178 |
| 1,999,943 | 4/1935 | Perazzoli | 51/178 |
| 2,093,969 | 9/1937 | Larsson | 51/204 |
| 2,096,424 | 10/1937 | Cooney | 51/178 |
| 2,124,273 | 7/1938 | Larsson | 51/178 |
| 2,380,789 | 7/1945 | Pronovost | 51/178 |
| 2,741,883 | 4/1956 | Scheuchzer et al. | 51/178 |
| 2,779,141 | 1/1957 | Speno, Jr. et al. | 51/178 |

FOREIGN PATENT DOCUMENTS

| | | | |
|---|---|---|---|
| 523364 | 4/1931 | Fed. Rep. of Germany . | |
| 1277069 | 9/1968 | Fed. Rep. of Germany | 51/178 |
| 2335981 | 1/1975 | Fed. Rep. of Germany . | |
| 52659 | 8/1910 | Switzerland . | |
| 227576 | 1/1925 | United Kingdom . | |

*Primary Examiner*—Nicholas P. Godici
*Assistant Examiner*—Roscoe V. Parker, Jr.
*Attorney, Agent, or Firm*—Kurt Kelman

[57] ABSTRACT

A mobile rail grinding machine comprises a machine frame mounted on the rails of a track for continuously moving in the direction of, and along, the track, a tool carrier frame vertically adjustably mounted on the machine frame, a rail grinding tool or a group of such tools mounted on the carrier frame for vertical adjustment in a direction vertical to the machine frame to press the tool or tools against surface areas of the rails to grind irregularities off the surface areas, and a drive for imparting to the tool carrier frame a reciprocating working movement in the direction of the track independent of, and additional to, that simultaneously imparted to it by the movement of the machine frame. The invention also is directed to a rail grinding method wherein the rail is ground by such a compound working movement.

33 Claims, 13 Drawing Figures

Fig. 4
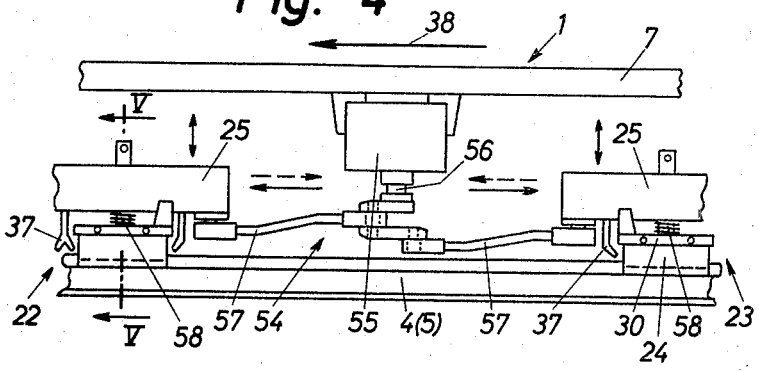
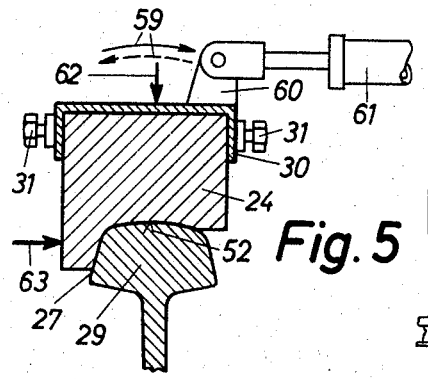
Fig. 5
Fig. 6
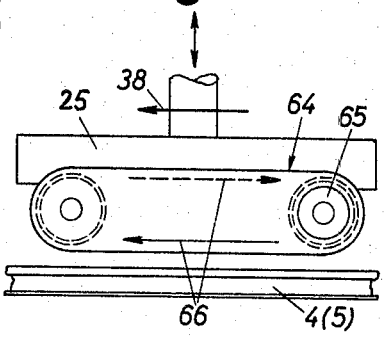
Fig. 7
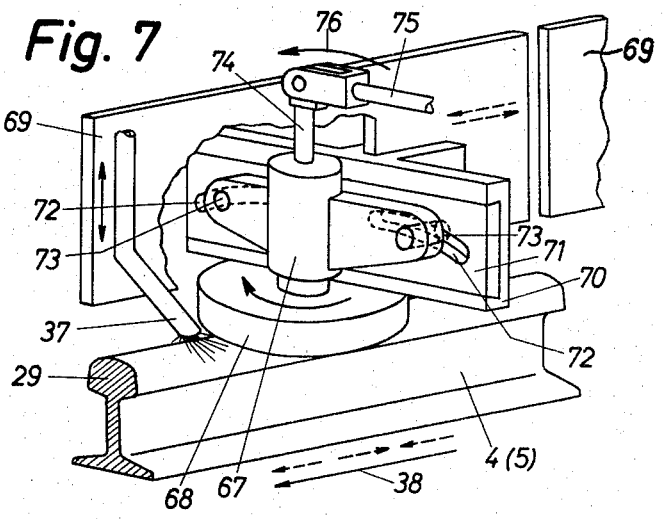

MOBILE RAIL GRINDING MACHINE AND METHOD

The present invention relates to a mobile rail grinding machine which comprises a machine frame mounted on the rails of a track for continuously moving in the direction of, and along, the track, a tool carrier frame, and a rail grinding tool or a group of such tools mounted successively in the track direction and arranged on the tool carrier frame, the tool or tools being adapted to grind irregularities off surface areas of the rails when pressed thereagainst, the tool or tools being mounted on the machine frame for vertical adjustment in a direction vertical to the machine frame, and means for vertically adjusting the tool or tools for pressing the same against surface areas of the rails to be ground. This invention also relates to a method of grinding a rail of a track, which comprises continuously moving the machine frame in the direction of, and along, the track, mounting the rail grinding tool on the machine frame, and pressing the tool against the surface areas of the rail while continuously moving the machine frame whereby a grinding movement is imparted to the tool in the track direction.

In the proper maintenance of tracks, increasing importance has been ascribed to keeping the surface areas of the rail heads, which are contacted by the flanged wheels of passing trains, free of irregularities by regularly grinding these surface areas. Mobile rail grinding machines have been used for this maintenance work. Because of rising traffic density, heavier trains and increased speeds, surface irregularities, such as ripples or corrugations, are encountered with increasing frequency and severity in track rails. These deformed and worn rail running surfaces are a safety hazard and force reductions in the speed of trains, in addition to causing discomfort to the passengers, due to vibrations of the cars and noise. Furthermore, the rails are subjected to excessive vibrations and this causes loosening of the rail fasteners as well as changes in the track position and a loosening of the ballast compaction in the region of the ties which rest on the ballast.

Mobile rail grinding machines have been developed to meet the need for properly maintaining the surface areas of rail heads. German patent No. 1,206,461, for example, discloses a rail grinding car with rotary grinding tools. In this machine, two grinding tool units are mounted on their own tool carriers each running on undercarriages on the track rails successively in the track direction and arranged between the undercarriages of the machine. Each grinding tool unit has three separately vertically adjustable grinding devices per rail, each grinding device comprising a drive motor with a vertical output shaft and a grinding disc affixed to the lower end of the shaft. A complex and multi-component control system is provided for adjusting the contact pressure of each grinding device on the surface area of the rail to be ground. The control structure is expensive to build and to maintain and, furthermore, only relatively narrow surface areas of the rail head can be ground with the rotating grinding tools, to the exclusion of the flanks of the rail head. Therefore, it is not possible to grind the entire surface area of the rail head which is in contact with the flanged wheels of passing trains to the desired smoothness and shape. Since the grinding discs are essentially only in line contact with the surface of the rail head, the grinding efficiency of such devices, i.e. the amount of material that is ground off during one pass of the machine, is relatively low.

It has also been proposed to combine a number of grinding cars equipped with rotary grinding devices into a rail grinding train to reduce the number of grinding passes required to eliminate rail surface irregularities. This is an advantage because grinding proceeds relatively slowly i.e. the forward speed of such grinding trains has a maximum speed of about 3000 m/h, and can, therefore, be carried out only during longer train intervals. Such a grinding train is usually propelled by two locomotives with a high transmission ratio. Such grinding trains are expensive to construct and operate. In addition, machines with these rotary grinding tools require high technology in the proper guidance and control of the grinding tools, not to speak of the inadequate shaping of the rail heads produced thereby and the problems arising out of obstacles encountered by the grinding tools, such as magnetic rail contacts, crossings and the like.

German patent No. 1,021,746 discloses a rail grinding machine working with elongated gliding whetstones which have a generally planar grinding face pressed against the rail head to grind its surface as the machine passes along the track. Groups of such whetstones mounted successively in the track direction may be arranged on the machine but the grinding efficiency is relatively low because the working movement of the grinding tools is obtained merely by the speed of the forward movement of the machine. While this is substantially higher than that of the grinding machines with rotary grinding tools, a number of grinding passes are needed to remove even the most glaring surface irregularities. A smooth continuity of a properly ground rail over a lengthy track section cannot be obtained with this machine. Therefore, this type of machine has not been in general use, being assigned only of tasks requiring relatively low grinding efficiencies, such as the grinding of streetcar track rails.

Such elongated whetstones, which grind surface irregularities off rails by a relative gliding movement between whetstone and rail, have also been used for surface grinding of new or old rails which are moved in contact with stationary whetstones. For example, German Auslegeschrift No. 1,277,069 discloses an apparatus comprising a roller conveyor on which the rails to be ground are slowly moved at a constant speed. A grinding unit comprised of three separately vertically adjustable whetstones mounted on a tool carrier frame is arranged for movement on rollers along the rails. The tool carrier frame is relatively slowly and periodically reciprocated in the direction of rail elongation by a stationary crank drive. The contact pressure of the gliding whetstones with the rails is so staggered that the gliding whetstone which first contacts the rail when the carrier frame moves opposite to the direction of movement of the rail is under the greatest contact pressure for rough grinding of the rail surface. The two successive whetstones are under decreasing contact pressure. This apparatus is useful in smoothing the surfaces of freshly milled rails.

It is the primary object of the present invention to provide a mobile rail grinding machine and method of high efficiency and which avoids the disadvantages of the highly complex and expensive constructions discussed hereinabove.

It is a concomitant object of this invention to provide a machine and method of this improved type which enables substantially all the surface irregularities of worn rails to be removed while simultaneously restoring the desired shape of the rail head.

It is a further object of the invention to enable such a machine and method to produce a substantially uniform grinding result over long track sections, regardless of the alignment and the surface condition of the rails of the track.

The above and other objects are accomplished according to one aspect of the present invention by providing, in a mobile rail grinding machine of the first-indicated structure, a drive for imparting to the tool a working movement in the direction of the track additional to, and superimposed on, that simultaneously imparted to it by the movement of the machine frame.

According to a preferred embodiment, the drive is arranged to impart to the rail grinding tool reciprocatory movements in opposite senses to constitute the additional working movement.

In accordance with another aspect of this invention, the first-indicated rail grinding method is improved by driving the rail grinding tool in reciprocatory movements in opposite senses in the track direction and in relation to the machine frame to impart simultaneously an additional grinding movement to the tool. Preferable, the additional grinding movement is effectuated in adjacent regions of the rail surface areas in opposite senses.

With this rail grinding method, it is possible not only to remove surface ripples in the rail rapidly but more extended rail surface irregularities may be eliminated with equal efficiency. This is obtained by grinding in opposite senses, i.e. with a grinding tool that moves back and forth over the extended surface irregularities whereby the grinding result is considerably improved. By grinding in opposite senses in adjacent regions of the rail surface areas, which may include not only the upper running surface of the rail head but also its inner flank in contact with the flanged wheels of passing trains, the reaction forces resulting from the friction of the grinding tools with the rail surface are opposed to each other and thus prevent vibration of the rail.

With such a mobile rail grinding machine the grinding efficiency has been unexpectedly multiplied because the effective grinding path of the rail grinding tool or tools grouped on a carrier frame has been substantially increased when compared in the working path obtained merely by the forward movement of the machine frame. By superimposing the additional working movement on the continuous movement due to the forward drive of the machine, the surface areas of the rails to be ground are passed over several times by each tool, which increases not only the grinding depth considerably but also substantially enhances the grinding quality. This high-quality smoothing effect is obtained not only with gliding whetstones as grinding tools but can also be obtained at least partially with the use of rotating grinding discs since the additional working movement of the grinding discs in the track direction relative to the rail elongation and in the direction thereof substantially eliminates chatter marks.

The basic concept of this invention may be incorporated in a variety of relatively simple structural embodiments, particularly in mobile rail grinding machines which are self-propelled and carry their own power supplies. The drive for imparting to the rail grinding tool or tools the additional working movement in accordance with the invention may then be powered electrically, hydraulically or pneumatically, for example. by the same power source used for operating the machine. Preferably, the entire operation may be controlled from a central control panel in an operator's cabin on the machine frame.

The above and other objects, advantages and features of the machine and method of the present invention will become more apparent from the following detailed description of some now preferred embodiments thereof, taken in conjunction with the accompanying schematic drawing wherein FIG. 1 is a side elevational view of a mobile rail grinding machine according to this invention;

FIG. 4 is a partial side elevational view of a mobile rail grinding machine showing another embodiment of a rail grinding tool arrangement according to the invention;

FIG. 5 is a schematically simplified sectional view of a rail grinding tool and its holder, along line V—V of FIG. 4, on an enlarged scale;

FIG. 6 is a side elevational view of yet another embodiment of a rail grinding tool arrangement for a mobile rail grinding machine in accordance with the present invention;

FIG. 7 is a perspective view of still another embodiment of such a rail grinding tool arrangement.

Figures 1, 2, 3:
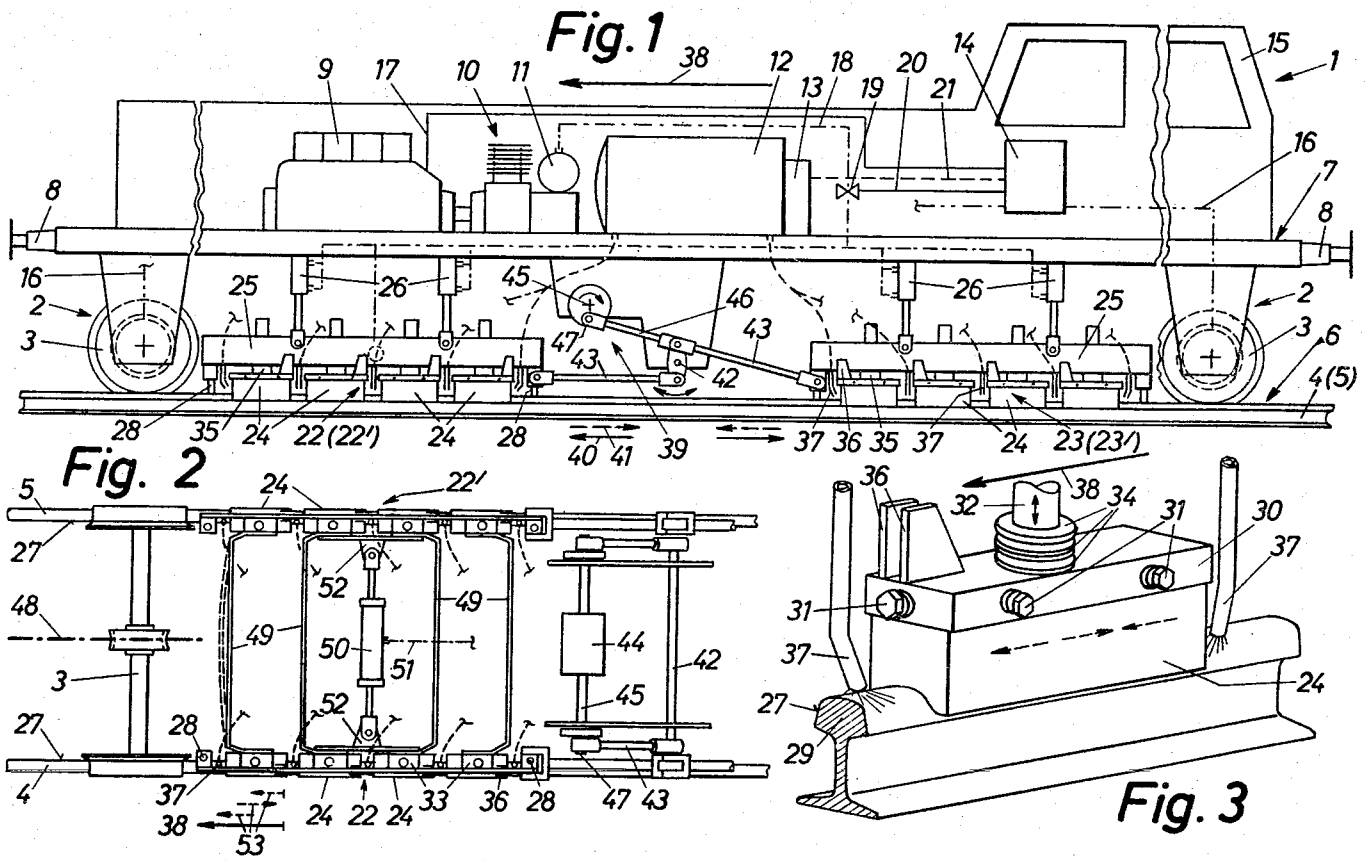
FIG. 2 is a top view of the rail grinding tool arrangement and the drive therefor of the machine of FIG. 1.
FIG. 3 is a perspective view of a rail grinding tool of the machine of FIGS. 1 and 2.

Referring now to the drawing and first to FIGS. 1 to 3, there is shown mobile rail grinding machine 1 comprising machine frame 7 mounted on rails 4 and 5 of track 6 for continuously moving in the direction of, and along, the track, as indicated by arrow 38. The machine frame is mounted on undercarriages 2 and runs on driven wheels 3. Couplings 8 at respective ends of machine frame 7 enable the mobile rail grinding machine to be incorporated as a car in a working train. Various mechanisms for driving the machine, controlling the operation thereof and supplying power thereto are arranged on the machine frame, these mechanisms including drive motor 9, compressor unit 10 connected to compressed air container 11, water tank 12 with valve arrangement 13 and central control panel 14 arranged in operator's cab 15 enabling an operator in the cab to operate the machine. The transmission from drive motor 9 to wheels 3, which usually comprises multistage gearing and cardan shafts, has been schematically shown by chain-dotted line 16, the motor being connected to central control panel 14 by control line 17. Control line 20 connects the control panel to valve arrangement 19 in compressed air conduit 18 for controlling the compressed air flow from container 11 which is connected to one end of the compressed air conduit, and control line 21 connects control panel 14 to valve arrangement 13 of water tank 12 for controlling the water flow from the tank.

Two groups 22, 23 and 22', 23' of rail grinding tools 24 are respectively associated with rails 4 and 5, the rail grinding tool groups being arranged on machine frame 7 between undercarriages 2. Each rail grinding tool is adapted to grind irregularities off surface areas of rails 4 and 5 when pressed thereagainst, and they are arranged successively in the track direction and for adjustment in a direction vertical to machine frame 7 for pressing the tools against the rail surface areas to be ground. The two groups of rail grinding tools associated with each rail are arranged spaced from each other in the track direction.

In the embodiment illustrated in FIG. 1, each group of rail grinding tools consists of four tools 24 spaced from each other in the track direction and consisting of whetstones. The four grinding tools of each group are mounted on common tool carrier frame 25 and each tool is individually vertically adjustable on the carrier frame. Tool carrier frame 25 is illustrated as a metal sheet extending in a substantially vertical plane in the track direction and constituting a longitudinal carrier flexible in a direction transversely to track 6.

Each tool carrier frame 25 is suspended from machine frame 7 for pendulum movement relative to the machine frame by means of telescoping, longitudinally adjustable suspension elements consisting, in the illustrated embodiment, of pneumatically operated cylinder-and-piston devices 26 connected to compressed air conduit 18. The devices may be controlled by operation of valve arangement 19 from control panel 14. Longitudinal carrier 25 is guided along the associated rail by means of two guide pins 28 engaging the inner flank 27 of rail head 29 of the associated rail.

As best shown in FIG. 3, each grinding tool is constituted by substantially parallelepiped whetstone 24 which has a grinding surface of a profile corresponding to the desired configuration of the ground surface area of rail head 29 against which it is pressed during the grinding operation. The elongated gliding whetstone is detachably mounted on tool holder 30 by means of screws 31. The tool holder has a vertically projecting guide bolt 32 reciprocably guided in a corresponding guide bore in guide block 33 carried by tool carrier frame 25 so that each tool is individually vertically adjustable. Depending on the selected grinding method, each tool holder rigidly or yieldingly engages an underside of the carrier frame, FIG. 3 showing a yielding embodiment provided by cup springs 34 mounted on guide bolt 32 while FIG. 1 illustrates a rigid engagement provided by spacing sleeves 35 mounted on the guide bolt. To hold the tool holders against rotation in relation to the rail and to align whetstone 24 properly with the rails, two guide elements 36 are arranged on the upper surface of each tool holder 30 and engage carrier frame 25 in a fork-like manner.

Water spray nozzles 37 are arranged on tool carrier frame 25 to direct water sprays into the spaces between successive grinding tools to cool the whetstones and to remove chips or shavings resulting from the rail grinding operation. An additional water spray nozzle is mounted immediately adjacent each end of each grinding tool group. As shown by broken lines, the water spray nozzles are connected to water tank 12 and the water delivery to the nozzles is controlled through valve arrangement 13 from central control panel 14.

In accordance with the present invention and to enhance the grinding efficiency of whetstones 24, a drive is provided for imparting an additional working movement to the whetstones simultaneously with the movement of the machine frame in the direction of arrow 38. In the embodiment illustrated in FIG. 1, this drive is common driving mechanism 39 connected to groups 22 and 23 associated with rail 4 (a like mechanism being connected to groups 22' and 23' associated with rail 5) for reciprocating the two groups of rail grinding tools in opposite directions, as indicated by arrows 40 and 41, in the direction of track 6, as indicated by arrow 38. In this manner, the grinding tools are operated with a compound working movement consisting of a first component resulting from the movement of the machine along the rails and a second compartment resulting from the additional movement of the tools in relation to the machine. The opposite additional movements of the groups of grinding tools assure at least substantial compensation of the longitudinal forces resulting from the friction between whetstones 24 and the surface areas of the rail heads which are ground.

The reciprocatory additional working movement of the rail grinding tools, particularly of gliding whetstones, favors not only the rapid and complete removal of ripples in the rail surface but also of surface irregularities of greater length, for instance of the order of magnitude of the entire length of a group of rail grinding tools. The opposite adidtional movement of the two groups of rail grinding tools associated with each rail furthermore prevents reaction forces resulting from the grinding friction forces between the tools, particularly between elongated gliding whetstones and the rail head surface, to be transmitted to the machine frame. Using a common driving mechanism for two groups of rail grinding tools provides a simple machine construction of high space and weight economy. With the use of gliding whetstones to which a reciprocatory working movement is imparted, the original rail head shape may be readily restored without utilizing complicated guide and control devices for the grinding tools. Gliding whetstones also are better adaptable to prevailing curvatures in the rails than rotary grinding tools so that devices for guiding tools laterally in track curves may be relatively simple.

Illustrated common driving mechanism 38 comprises crank shaft 42 extending transversely to the longitudinal extension of machine frame 7 and being substantially coplanar with tool carrier frames 25 of the two groups of grinding tools. The crank shaft has two crank arms offset from each other by 180°, a respective one of tool carrier frames 25 being linked to a respective crank arm by means of push rod 43. Crank shaft 42 is rocked back and forth by crank drive 46 operated by cam or eccenter shaft 45 rotated by motor 44 which is mounted on machine frame 7 in a plane extending above the plane defined by crank shaft 42 and carrier frames 25. Motor 44 may be a hydraulic motor whose rotational speed may be adjusted to control the frequency of the reciprocal rocking movement of crank shaft 42 and the corresponding additional working movement of the grinding tools, for example in dependence on the speed of forward movement of machine 1, so that the compound working movement of grinding tools 24 may be suitably varied and adapted to desired operating conditions. A useful guiding value for an average frequency of the reciprocal rocking movement may be a frequency of the order of magnitude of about 8 Hz. A useful length of the entire reciprocal stroke may be at least half that of whetstones 24, preferably about two thirds of this length. It is desirable to make the length of the reciprocal stroke adjustable, for which purpose pivot pin 47 connecting crank drive 46 to encounter shaft 45 may be movable in a radial direction to effect the desired adjustment.

As shown in FIG. 2, the pairs of groups 22, 22' and 23, 23' of rail grinding tools 24 arranged symmetrically in relation to longitudinal plane of symmetry 48 of machine 1 are interconnected by transverse beams 49 in the illustrated embodiment. These beams may be metal sheets extending in a substantially vertical plane transversely to the track direction and flexible in the track direction, as shown by broken lines at the left in FIG. 2. In other words, the tool carrier frames and the transverse beams are similar metal sheet structures, and beams 49 are affixed to tool carrier frames 25 in the region of guide blocks 33 of two tool holders 30 arranged symmetrically in relation to plane of symmetry 48. The length of the transverse beams is preferably adjustable to enable the distance between the symmetrically arranged groups of rail grinding tools to be adjusted in accordance with the prevailing track gage, particularly in track curves, thus always assuring proper engagement of the grinding surfaces of the grinding tools with the surface areas of the rails to be ground. A horizontally extending motor 50 is linked to tool carrier frames 25 of the symmetrically arranged groups of rail grinding tools to enable the transverse distance therebetween to be adjusted, the motor being connected to compressed air conduit 18 by connecting line 51 so that the transverse adjustment may be controlled from central control panel 14. The outer ends of the piston rods of motor 50 are linked to brackets 52 on tool carrier frames 25.

During movement of machine 1 from one operating site to another and when it is desired to mount or replace a grinding tool 24, tool carrier frames 25 are lifted by operating pneumatic motors 26. Screws 31 are loosened to remove a whetstone from holder 30 and a new whetstone is mounted thereon from below, whereupon the screws are tightened again. Different wear of the whetstones of one group may be compensated by mounting spacing sleeves 35 of different lengths on guide bolts 32 of the respective tool holders. Grinding tools of suitable materials, profiles and grain structure may be selected to assure proper grinding under given operating conditions. For instance, if desired, whetstones with originally flat grinding faces may be used, which will assume the profile of the engaged rail head surfaces after relatively brief operation. In this manner, a continuous curved running surface will be ground on the rail heads. If it is desired also to grind the inner flank 27 of rail head 29, i.e. all surface areas of the rail head which are contacted by the flanged wheels of passing trains, it will be useful to work with whetstones having a pre-shaped grinding surface having the profile of a flanged wheel. To produce a smoothing effect progressively increasing in the direction of machine movement, the groups of grinding tools may have whetstones of different granular structure. Furthermore, in view of the individual vertical adjustability of the grinding tools, it is possible to vary the contact pressure of the grinding tools on the rail heads progressively in the direction of the track.

In operation, tool carrier frames 25 are lowered by pneumatic motors 26 to enable grinding tools 24 to be pressed against the rails under a controlled pressure. The lateral guidance and pressing contact of tools 24 with the surface area of rail heads 29 to be ground is assured by the flexibility of transverse beams 49. Motors 9 and 44 are operated simultaneously to drive machine 1 along the track in the direction of arrow 38 while the grinding tools are rocked back and forth in the directions of arrows 40 and 41 whereby a compound working movement is imparted to tools 24, increasing the length of the grinding path of each whetstone at least three times, as compared to the length of the grinding path produced solely by the continuous forward movement of the machine. This is illustrated in FIG. 2 by arrows 53 (amplitudes of the reciprocating working movement of the grinding tools) as compared to forward movement 38 of machine 1.

In the embodiment of FIG. 4, machine 1 is represented solely by machine frame 7 and only portions of grinding tool carrier frames 25 on which groups 22 and 23 of grinding tools 24 are mounted are shown. All structures designated by like reference numerals function in a like manner as in the embodiment of FIGS. 1–3, the embodiment of FIG. 4 differing therefrom only in the illustrated manner described hereinbelow.

Common driving mechanism 54 for the two groups of grinding tools comprises, in this embodiment, crank shaft 56 having an axle extending vertically to machine frame 7 and connected directly to the output shaft of motor 55. The crank shaft has two crank arms offset from each other by 180°, a respective one of tool carrier frames 25 being linked to a respective crank arm by means of connecting rods 57. With a symmetrical grinding tool arrangement, as shown in FIG. 2, crank shaft 56 may be positioned in longitudinal plane of symmetry 48 of the machine centrally between the two groups 22 and 23 of the grinding tools and all the grinding tool groups may be operated by the central crank shaft.

In the embodiment of FIG. 4, coil springs 58 assure a yielding contact of tool holders 30 with the underside of carrier frame 25.

In the illustrated embodiments, two tool carrier frames 22, 23 and 22', 23' are mounted on machine frame 7 successively in the track direction in association with each rail 4 and 5, and respective ones of frames 22, 22' and 23, 23' associated with each rail form pairs of frames, common driving mechanism 39 or 54 being arranged for synchronously imparting to the pairs of frames reciprocatory movements opposite to each other in the track direction. This synchronous drive produces not only a uniform grinding result for both rails but it also prevents vibration phenomena due to different motion rhythms or phase differentials in the reciprocatory movements of the grinding tools over the right and left rails. This synchronous drive is particularly useful in the illustrated embodiment wherein transverse beams 49 combine the pairs of carrier frames into a structural unit. When the common driving mechanism is mounted substantially centrally between the two carrier frames and in a central plane of symmetry of the track between the rails, the resultant uniform mass distribution will assure a largely vibration-free operation.

The coplanar arrangement of the carrier frames and common drive therefor, as shown in FIG. 1, prevents substantial reaction forces from being generated by the driving force in a vertical plane passing through the rails, which would lead to periodically varying contact pressure distribution over the several grinding tools. Furthermore, the structural components used in this embodiment are very robust and simple.

Driving mechanism 54 of FIG. 4 provides great space economy and has the further advantage that the crank arms of the crank drive and the connecting rods linked thereto may be arranged just above the plane of the track so that the moments transmitted to the carrier frames by the drive forces are minimal.

It is particularly advantageous to make the rotational speed of the drive motor and/or the crank drive adjustable for control in dependence on the forward speed of the machine. In this manner, the forward speed and the speed of the additional working movement may be tuned to each other to produce an optimal grinding result while operating at highest efficiency under all operating conditions. This speed adjustment may be automatically controlled so that the machine operator may concentrate on other operations.

By mounting the grinding tools vertically adjustably on their carrier frames and placing spacers, such as cup springs, compression springs or spacing sleeves, between the tools and the underside of the carrier frame, an undesirable automatic adjustment of the tools to vertical projections of the contacted rails is prevented, i.e. the tools are not moved up and down automatically while they pass over an undulating rail head surface. At the same time, where the carrier frames are transversely flexible, as assured by metal sheets extending in a vertical plane, the yield of the elongated carrier frames will assure a lateral adaptation of the elongated whetstones to the rails. In this way, the successive elongated whetstones in each group form, in operation, a grinding body having the length of the entire group, thus being able to grind surface irregularities in the rail head which exceed the length of each whetstone and may have a length of about two thirds to three quarters of the entire length of the group of grinding tools.

The transverse flexible connecting beams 49 serve to press the oppositely positioned whetstones against the inner flanks of the rail heads, these beams being affixed to the carrier frames in the range of the tool holders, and additionally prevent an oblique displacement of the gliding whetstones about their longitudinal axis. Also, these preferably longitudinally adjustable transverse connecting beams permit the pairs of tool carrier frames with their tools to be adjusted to different track gages, particularly in track curves.

The illustrated cylinder-and-piston suspension of the tool carrier frames on the machine frame and the horizontal adjustability of the carrier frames are simple means assuring proper contact pressure between the grinding tools and the rail surface areas to be ground.

FIG.5 illustrates a specific embodiment of whetstone 24 used for grinding not only the upper running surface of rail head 29 but also its inner flank 27. As shown, the section of the whetstone is similar to that of a flanged wheel. Tool holder 30 is mounted for pivoting in the direction of arrows 59 in a direction transverse to the track about a pivoting axis extending in the track direction. For this purpose, holder 30 may be moved along a guide patterned after an enveloping curve for the rail running surface. The holder is pivoted by motor 61 linked to bracket 60 of holder 30. Arrows 62 and 63 illustrate the vertical and lateral pressure forces exerted upon whetstone 24 by the pivoting action. This enables the upper running surface 52 as well as inner flank 27 of the rail head to be uniformly and smoothly ground to the desired shape.

In the rail grinding tool arrangement of FIG. 6, carrier frame 25 carries a grinding tool consisting of endless abrasive band 64 trained over a pair of pulleys one of which is driven by motor 65 for driving the abrasive band continuously in the direction of arrows 66. This imparts to the grinding tool an additional working movement superimposed on the working movement imparted thereto by the continuous forward movement of the machine on which this grinding tool arrangement is mounted. This embodiment produces a high grinding efficiency with a relatively low contact pressure of the abrasive band and an excellent grinding quality, particularly when motor 65 is driven at a high rotational speed. It has the further advantage of providing ready adaption of the abrasive band to the profile of the rail and permits simple and rapid replacement of the abrasive band.

FIG. 7 shows a rail grinding tool arrangement in which the grinding tool is a substantially horizontally extending grinding disc 68 mounted for rotation about a substantially vertical axis by motor 67. One or more such tools are mounted on carrier frame 69 extending in the direction of the track and mounted on the machine frame for vertical adjustment in relation thereto, as generally described hereinabove in connection with carrier frame 25. Two longitudinally spaced carrier frames 69 are rocked back and forth in the manner shown, for example, in FIG. 1 or 4 to impart to the rail grinding tools mounted on the carrier frames a working movement superimposed on the movements imparted to them by the continuous forward movement of the machine along the track and by the rotation of grinding discs 68. Furthermore, the rotary grinding disc and its motor form a unit which is mounted on carrier frame 69 for pivoting in a direction transverse to the track to accomplish the result described hereinabove in connection with FIG. 5. For this purpose, transverse beam 70 is affixed to carrier frame 69 and this beam defines a dovetailed guide receiving guide plate 71 which defines arcuate guide slots 72 engaged by guide pins 73 mounted on brackets 77 projecting in diametrically opposed directions from motor 67. Piston rod 75 of a motor (not shown) is linked to element 74 projecting axially from motor 67. Thus, reciprocation of piston rod 75 will transversely rock motor 67 and rotary grinding disc 68 in the direction of arrow 76 along a path defined by arcuate guide slots 72. This makes individual grinding of the rails possible, particularly when several grinding discs are mounted on the same carrier frame at different angles in relation to the rail to be ground. It may be desirable to combine this arrangement with grinding tool arrangements using parallelepiped whetstones, for instance by arranging rotary grinding discs at both ends of machine 1 while grinding whetstones, such as shown at 24, are arranged therebetween.

Figure 8:
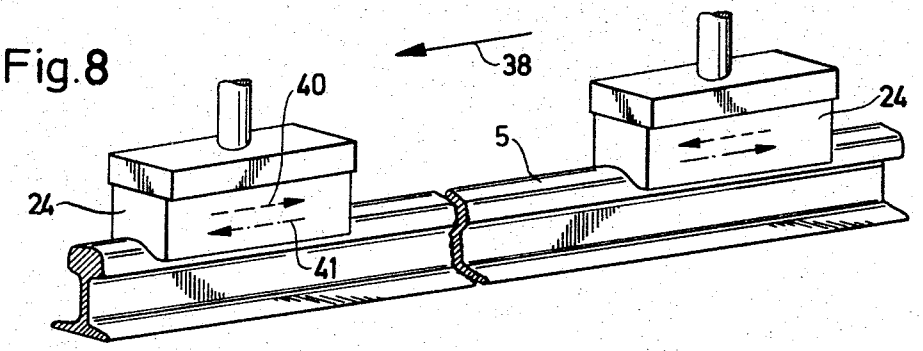
FIG. 8 schematically shows the principle of the rail grinding method of this invention.

Like reference numerals designate like parts functioning in a like manner in FIG. 8 for a schematic illustration of the principle of the rail grinding method according to the present invention. As shown, elongated gliding whetstones 24 are pressed against the surface areas of rail 5 to grind irregularities off these surface areas while continuously moving the machine frame in the direction of arrow 38 whereby a grinding movement is imparted to the whetstones in this direction, and each rail grinding tool 24 is driven in reciprocatory movements in opposite senses in this direction, as indicated by oppositely pointing arrows 40 and 41, and in relation to the machine frame to impart simultaneously an additional grinding movement to the tool. As shown, the additional grinding movement is effectuated in adjacent regions of the rail surface areas in opposite senses by two adjacent, oppositely reciprocating whetstones.

Figure 9:
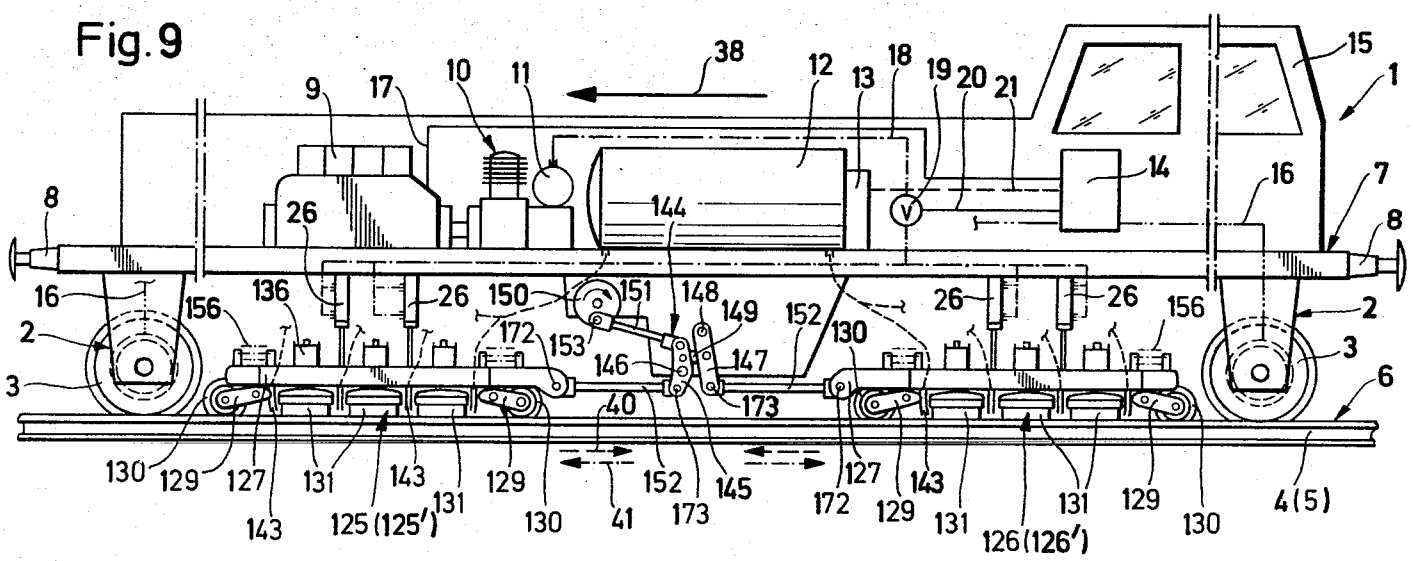
FIG. 9 is a side elevational view of a mobile rail grinding machine incorporating a preferred embodiment of a tool arrangement capable of carrying out the method of the invention.
Figure 12:
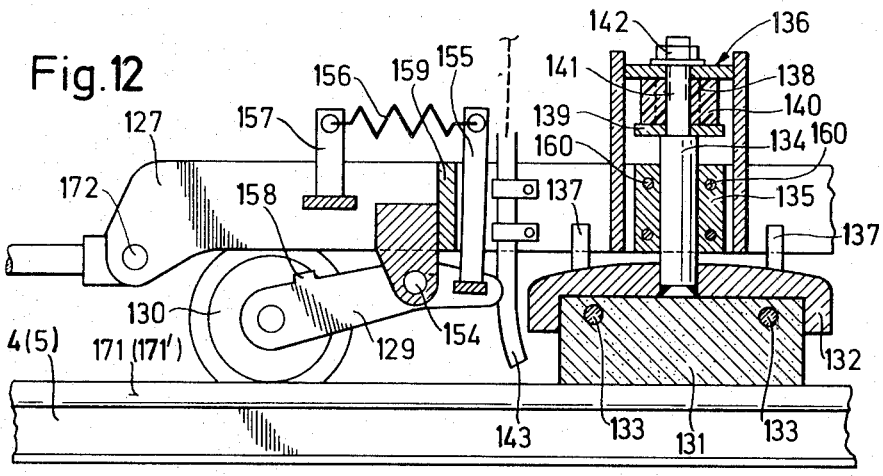
FIG. 12 is an enlarged view, partly in section, showing a detail of the tool carrier frame of the embodiments of FIGS. 9 and 10.

To avoid redundancy in the description of the mobile rail grinding machine of FIG. 9, like structural parts operating in a like manner as in the machine of FIG. 1 have been designated with the same reference numerals. Similarly to the embodiment of FIG. 1, two groups 125, 126 and 125', 126' of elongated gliding whetstones 131 are respectively associated with rails 4 and 5, and each group of rail grinding tools is mounted on tool carrier frame 127 suspended from machine frame 7 centrally between respective ends thereof by two pneumatically operated cylinder-and-piston devices 26. As shown, each group of rail grinding tools is comprised of three elongated whetstones 131 arranged successively in the track direction. Flanged wheels 130 support each tool carrier frame at respective ends thereof on the rails. As best shown in FIG. 12, a resiliently yieldable support constituted by double-armed swinging arm 129 connects each flanged wheel 130 to tool carriage frame 127. The swinging support arm is pivoted to the carriage frame at horizontal pivot axle 154 extending transversely to the track. One of the arms of support 129 carries the flanged wheel while its other arm is connected to rod 155 passing through the carriage frame and having its upper end connected to one end of tensile spring 156 whose other end is connected to support rod 157 affixed to the carrier frame. These yieldably mounted flanged wheels securely guide the tool carriage frames along the track rails and facilitate the accurate engagement of the rail grinding tools with the rails when the carriage frames are lowered by operation of pneumatic devices 26.

The substantially parallelpiped, elongated gliding whetstones 131 are detachably mounted in tool holders 132 by means of screws 133. As best shown in FIG. 12, the tool holder has a vertically projecting guide bolt 134 reciprocably guided in a corresponding guide block 135 which is affixed to the carrier frame by screw bolts 160. Stop 136 is affixed to the carrier frame in the vertical path of guide bolt 132 and, depending on the selected grinding principle, the upper end of the guide bolt engages stop 136 rigidly or yieldingly. A rigid engagement is indicated in FIG. 12 in broken lines by metal sleeve 138 mounted between stop 136 and flange 139 affixed to the upper end of the guide bolt. In this manner, the vertical position of the grinding tool in relation to its carrier frame is fixedly predetermined. A yielding engagement is indicated in full lines by elastic member 140 constituted by an elastomeric material. Equivalently, a cup or coil spring may be interposed between the guide bolt and stop 136. Tool holder 132 is mounted on stop 136 by threaded portion 141 and nut 142. To hold each tool holder aligned with the rail and against rotation in relation to the carrier frame, two retaining pins 137 project upwardly from the tool holder into lateral engagement with the carrier frame.

In the illustrated embodiment, tool carrier frame 127 consists of two metal sheets extending in vertical planes and stops 136 for the grinding tools interconnect the two metal sheets of the carrier frame.

Similarly to the embodiment of FIG. 1, a common driving mechanism 144 is connected to carrier frames 127 associated with each rail for reciprocating the two groups of rail grinding tools respectively mounted on the carrier frames in opposite senses indicated by arrows 140 and 141. This at least approximately compensates the longitudinal forces exerted by the two groups of grinding tools due to the friction between gliding whetstones 131 and the surface areas of the rails against which they are pressed.

Illustrated drive mechanism 144 comprises a motor which rotates a crank shaft 150 and two levers operatively connected to the motor for pivoting about respective horizontal axes extending transversely to the track. In the illustrated embodiment, the levers are operatively connected to the motor by push rod 151 having one end linked to crank shaft 150 while its other end is linked to one of the lever 145. Lever 145 is a two-armed lever mounted on the machine frame on horizontal pivot axle 146 and having its end remote from the track plane linked to rod 151. The other lever is single-armed lever 147 whose end remote from the track plane is mounted on the machine frame on horizontal pivot axle 148. Rigid push-pull connecting element 149 links the remote end of two-armed lever 145 to single-armed lever 147 to interconnect the two levers so that they are pivoted in unison by the power-driven crank drive. The ends of levers 145 and 147 closer to the track plane always move in opposite senses and are linked to the two adjacent tool carrier frames 127 by push-and-pull connecting rods 152. Pivotal connections 172 linking the rods to the carrier frames and pivotal connections 173 linking the rods to the levers have about the same distance from the plane of the track and the connecting rods extend in a plane parallel to the track plane and defined by the reciprocatory movements. During pivoting of levers 145 and 147, pivotal connections 173 move, of course.

As in the embodiment of FIG. 1, the rotational speed of the crank drive motor may be varied and the length of the reciprocal stroke may be adjustable, for which purpose pivot pin 153 connecting rod 151 to crank drive 150 may be movable in a radial direction.

With the illustrated drive, the driving force exerted upon the tool carrier frames extends in a direction substantially parallel to the track plane. No substantial vertical force components are transmitted to the carrier frames so that a uniform pressure of the rail grinding tools on the rail surface areas to be ground is assured, thus avoiding undesired differences in the grinding pressure. The common crank drive for an interconnected two-armed lever and a single-armed lever constitutes a very simple drive structure for imparting motions in opposite senses to the two adjacent carrier frames and for assuring the equal spacing of the pivotal connections from the track plane by means of a simple push-pull connecting rod. Although the spacing of the pivotal connections linking the connecting rods to the cranking levers from the track plane varies between two end positions as the levers pivot back and forth, this has no substantial effect on the carrier frames, particularly if the connecting rods have a suitable length, since such rods will in all positions extend substantially parallel to the surface of the rail. Thus, no substantial vertical forces will be transmitted to the carrier frames and a uniform grinding pressure can be assured by moving the tool carrier frame vertically against the track rails, preferably by pressure fluid, drives, such as devices 26.

In the embodiment of FIG. 9, each group of rail grinding tools mounted on a respective tool carrier frame comprises three elongated whetstones 131 and, while all three whetstones may be mounted rigidly in the frame, i.e. vertically immovable in relation thereto, it is also possible to mount the two grinding tools at respective ends of tool carrier frame 127 rigidly connected thereto, by interposition of spacing sleeve 138 between stop 136 and the tool holder, while the intermediate tool is vertically yieldably connected to the carrier frame, by interposition of elastic member 140. The vertically immovable mounting of the rail grinding tools in each group is particularly useful for grinding long-wave corrugations in the rail surface because none of the tools can move down into a valley between the corrugation crests and grind off material in the valley. It would also be possible to vary this arrangement by mounting the intermediate tool at a different vertical level than the outside tools. On the other hand, the rigid arrangement of the outside tools and the vertically yieldable mounting of the intermediate tool is advantageous when it is desired to grind off short ripples as well as long corrugations. The yieldingly mounted grinding tool will work primarily to remove the short ripples while the rigid rools will work on the long corrugations.

As shown in FIG. 12, swinging wheel supports 129 have stop means constituted by abutment 158 for limiting the vertical adjustment of tool carrier frame 127 in relation to machine frame 7. This makes it possible to limit the vertical movement of the rail grinding tools to a stroke determined by a predetermined thickness of abrasive material worn off the whetstones during the grinding operation. This positively prevents wearing of the grinding tools beyond an acceptable point at which the tool holders would be in contact with the rail and would thus be damaged by continuing grinding. The abutment projects upwardly from swinging wheel support 129 and will engage the underside of carrier frame 127 when the downward force exerted upon the carrier frame swings the support upwardly against the bias of spring 156 to a sufficient extent for abutment 158 to engage frame 127. When the tool carrier frame is lifted, for instance while the machine is moved from site to site and no grinding is desired, rod 155 connected to one of the arms of pivotal support 129 engages transverse metal sheet member 159 so as to limit the downward pivotal stroke of support 129.

Figure 10:
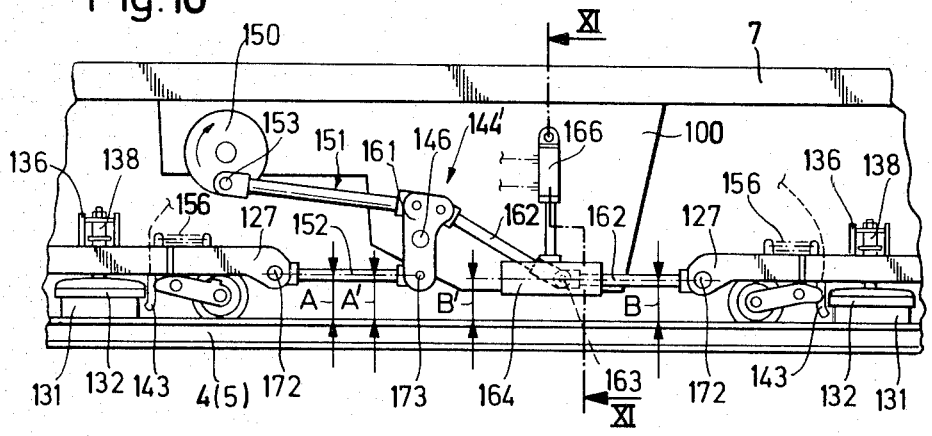
FIG. 10 is a side elevational view showing another such embodiment.

Like reference numerals indicate like parts functioning in a like manner in modified drive 144' of FIG. 10 to avoid redundancy in the description. In this embodiment, the drive mechanism includes a single double-armed lever 161 pivoting about horizontal axle 146. One of the carrier frames is linked to the end of lever 161 closer to the track plane by connecting rod 152 while the other lever end is linked to the other carrier frame by push-and-pull connecting element 162 which is articulated at point 163. Point of articulation 163 between the pivotal connections of connecting element 162 to lever 161 and carrier frame 127, respectively, is glidingly held in guide member 164 which extends substantially parallel to the plane of the track. Guide member 164 and pivotal connection 172 to carrier frame 127 have about the same distance from the plane of the track.

Figure 11:
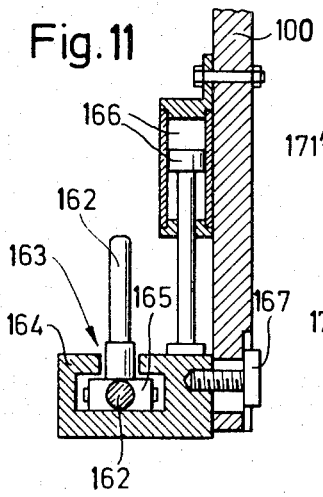
FIG. 11 is a sectional view along line X1—X1 of FIG. 10.

As best shown in FIG. 11, articulation 163 has a forked articulated connecting head 165 interconnecting the two parts of connecting element 162 and guide member 164 has a guide groove of T-shaped cross section, wherein the connecting head is glidingly received. Means is provided for varying the distance of guide member 164 from the track plane, the illustrated means comprising motor 166 whose cylinder is fixedly mounted on bracket 100 of machine frame 7 and whose piston is connected to the guide member. This enables the guide member to be held at a predetermined distance from the rail, and two guide bolts 167 have their heads in engagement with the backside of sheet metal bracket 100, the guide bolts extending from the guide member through slots in the bracket.

In this drive arrangement, distance A of pivotal connection 172 of connecting element 152 to one of carrier frames 127 from the track plane is about the same as that of distance A' of pivotal connection 173 of the connecting element to pivoting lever 161, the pivoting of the lever constantly changing the vertical position of connection 173 during the grinding operation. Distance B' of point of articulation 163 from the track plane can be adjusted to be exactly equal to distance B of pivotal connection 172 of connecting element 162 to the other carrier frame 127, and guide member 164 maintains distance B' constant during the grinding operation. This assures a force transmission to the latter carrier frame which constantly remains parallel to the rail. If desired, connecting element 152 may be replaced by an articulated element 162 to provide the same force transmission to both carrier frames.

If desired, the crank drives in the arrangements of FIGS. 9 and 10 may be replaced by the type of cranks with oppositely offset crank arms, as used in the embodiments of FIGS. 1 and 4. In either case, no vertical force component will be transmitted to the tool carrier frames by the drive.

Figure 13:
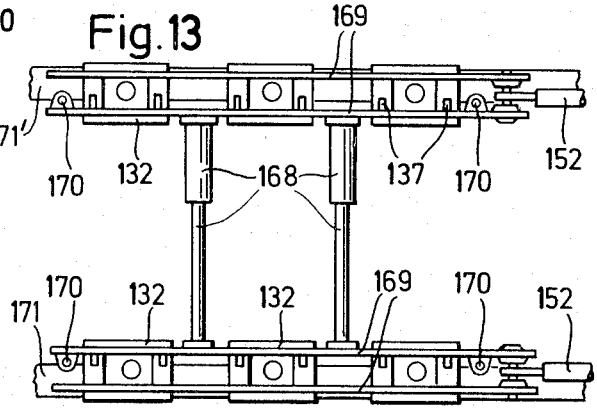
FIG. 13 is a schematic top view of a pair of shc tool carrier frames.

FIG. 13 shows a tool carrier frame arrangment for both rails, which assures good adaptation of the grinding apparatus to varying track gages. A tool carrier frame 169 is associated with each of the track rails and is mounted symmetrically with respect to a central plane of symmetry and a group of three rail grinding tools is mounted on each carrier frame. Two cylinder-and-piston devices 168 interconnect the two carrier frames for lateral adjustment with respect to each other. In this manner, operation of pressure fluid operated devices 168 assures that flanged wheels 130 or vertical guide bolts 170 are always pressed against the inner flanks 171, 171' of the rails even when the track gage changes. In the embodiment of FIG. 13, the flanged wheels 130 have been replaced by vertical guide bolts 170 to guide the carrier frames along the rails. Also, to assure guidance of the carrier frames along the rails without play under varying track gage conditions, devices 168 may be pivotally linked to the carrier frames.

What is claimed is:

1. A mobile rail grinding machine for continuously grinding irregularities off surface areas of track rails while the machine advances continuously along the track, which comprises (a) a machine frame, (b) undercarriages mounting the machine frame on the track rails, (c) means for continuously moving the machine frame on the undercarriages in the direction of, and along, the track, (d) a tool carrier frame, (e) a group of rail grinding tools mounted on the tool carrier frame successively in the track direction, the tools being adapted to grind the surface irregularities when pressed against the rails, (f) drive means for adjusting the transverse position of the tool carrier frame in relation to the machine frame, (g) suspension means for vertically adjustably mounting the tool carrier frame on the machine frame for swinging movement in the track direction and for pressing the tools against the surface areas of the rails to be ground, and (h) a drive connected to the tool carrier frame and operating independently of the means for continuously moving the machine frame for imparting to the tool carrier frame a reciprocatory working movement in the track direction additional to the movement simultaneously imparted to it by the continuous movement of the machine frame.

2. The mobile rail grinding machine of claim 1, wherein the tool carrier frame is an elongated carrier extending in a vertical plane defined by an associated one of the track rails and the carrier frame, the carrier being flexible in a direction transverse to the track.

3. A mobile rail grinding machine for continuously grinding irregularities off surface areas of track rails while the machine advances continuously along the track, which comprises (a) a machine frame, (b) undercarriages mounting the machine frame on the track rails, (c) means for continuously moving the machine frame on the undercarriages in the direction of, and along, the track, (d) a tool carrier frame, (e) a group of rail grinding tools mounted on the tool carrier frame successively in the track direction, the tools being adapted to grind the surface irregularities when pressed against the rails, (f) means for vertically adjustably mounting the tool carrier frame on the machine frame, (g) means for vertically adjusting each rail grinding tool for pressing the tool against the surface areas of the rails to be ground, and (h) a drive operating independently of the means for continuously moving the machine frame for imparting to the tool carrier frame a reciprocatory working movement in the track direction additional to the movement simultaneously imparted to it by the continuous movement of the machine frame, the drive comprising (1) a drive mechanism and (2) a push-and-pull connecting element linking the carrier frame to the drive mechanism, respective pivotal connections linking the connecting element to the carrier frame and to the drive mechanism, the pivotal connections having about the same distance from the plane of the track and at least a portion of the connecting element adjacent the tool carrier frame extending in a plane extending perpendicularly to the track plane and defined by the reciprocatory movements.

4. The mobile rail grinding machine of claim 3, comprising two of said tool carrier frames mounted on the machine frame successively in the track direction and associated with one of the rails, and wherein the drive mechanism comprises a motor, two levers operatively connected to the motor for pivoting about respective horizontal axes, the levers having respective ends remote and closer to the track plane, one of the levers being two-armed and the other lever being single-armed, the pivotal connections linking the closer ends of the levers to a respective one of the push-and-pull connecting elements linking the drive mechanism to a respective ones of the carrier frames, and another push-and-pull connecting element interconnecting the remote end of the two-armed lever to the single-armed lever.

5. The mobile rail grinding machine of claim 3, further comprising stop means for limiting the vertical adjustment of the tool carrier frame.

6. The mobile rail grinding machine of claim 3 further comprising flanged wheels supporting the tool carrier frame at respective ends thereof on the rails, and resiliently yieldable supports connecting the wheels to the carrier frame.

7. The mobile rail grinding machine of claim 6, wherein the supports have stop means for limiting the vertical adjustment of the tool carrier frame in relation to the machine frame.

8. The mobile rail grinding machine of claim 3, wherein a respective tool carrier frame is associated with each of the rails and mounted symmetrically with respect to a central plane of symmetry, and two cylinder-and-piston devices interconnecting the two tool carrier frames for lateral adjustment with respect to each other.

9. The mobile rail grinding machine of claim 3, wherein the rail grinding tools are constituted by elongated whetstones.

10. The mobile rail grinding machine of claim 3, wherein the rail grinding tools are constituted by rotary grinding discs.

11. The mobile rail grinding of claim 3, further comprising water spray means mounted on the machine frame for cooling the rail grinding tools.

12. The mobile rail grinding machine of claim 3, wherein the means for vertically adjustably mounting the tool carrier frame comprises two telescoping suspension elements suspending the tool carrier frame on the machine frame for pendulum movement in the track direction, and further comprising a drive means for transversely adjusting the tool carrier frame in relation to the machine frame.

13. The mobile rail grinding machine of claim 12, wherein the suspension elements and the drive means are cylinder-and-piston devices.

14. The mobile rail grinding machine of claim 3, wherein the tool carrier frame is an elongated carrier extending in a vertical plane defined by an associated one of the track rails and the carrier frame, the carrier being flexible in a direction transverse to the track, and having a lower edge facing the associated rail, and further comprising holders vertically adjustably mounted on the lower edge of the flexible elongated carrier for detachably receiving ones of the grinding tools.

15. The mobile rail grinding machine of claim 14, wherein the flexible elongated carrier is a metal sheet extending in said vertical plane.

16. The mobile rail grinding machine of claim 14, further comprising spacing sleeves arranged between the lower edge of the flexible elongated carrier and the holders for the vertical adjustment of the holders in relation to the carrier.

17. The mobile rail grinding machine of claim 14, further comprising cup spring means arranged between the lower edge of the flexible elongated carrier and the holders for yieldable vertical adjustment of the holders in relation to the carrier.

18. The mobile rail grinding machine of claim 14, comprising a pair of said tool carrier frames mounted on the machine frame, each of the carrier frames being associated with a respective one of the track rails, the tool carrier frames being transversely aligned and symmetric with respect of a longitudinally extending plane of symmetry of the machine frame, and further comprising transverse beams affixed to the tool carrier frames in the region of the holders and interconnecting the carrier frames of the pair, the transverse beams being flexible in the track direction.

19. The mobile rail grinding machine of claim 18, wherein the transverse beams are metal sheets extending in a vertical plane extending transversely of the track.

20. The mobile rail grinding machine of claim 3, comprising two of said tool carrier frames mounted on the machine frame successively in the track direction and associated with a respective one of the rails.

21. The mobile rail grinding machine of claim 20, wherein the drive is a common driving mechanism connected to the two carrier frames for imparting the reciprocatory working movements to the carrier frames.

22. The mobile rail grinding machine of claim 20, comprising two pairs of said tool carrier frames mounted on the machine frame, each two of the carrier frames being associated with a respective one of the track rails, the tool carrier frames of each pair being transversely aligned and symmetric with respect of a longitudinally extending plane of symmetry of the machine frame, and the common driving mechanism being connected to the pairs of carrier frames for synchronously reciprocating the carrier frames.

23. The mobile rail grinding machine of claim 22, wherein the common driving mechanism is mounted on the machine frame substantially centrally between the pairs of tool carrier frames and between the rails.

24. The mobile rail grinding machine of claim 21, wherein the common driving mechanism comprises a motor mounted on the machine frame, a crank drive operated by the motor, and reciprocatory connecting rods linking the crank drive to the two tool carrier frames.

25. The mobile rail grinding machine of claim 24, wherein the crank drive comprises a crank shaft extending in a direction transverse to the track, the crank shaft, the connecting rods and the two tool carrier frames being substantially coplanar in a horizontal plane, an eccenter shaft rotated by the motor and a push rod connecting the eccenter shaft to the crank shaft for rocking the crank on rotation of the eccenter shaft.

26. The mobile rail grinding machine of claim 24, wherein the crank drive comprises an eccenter shaft rotated by the motor and having a vertically extending axis, and the connecting rods linking the eccenter shaft to the two tool carrier frames.

27. The mobile rail grinding machine of claim 3, wherein the drive is arranged to impart to the carrier frame a reciprocatory movement having an adjustable frequency and stroke.

28. The mobile rail grinding machine of claim 27, wherein the length of the stroke of the reciprocatory movement is about two thirds of the length of the grinding tools and the frequency of the reciprocatory movements is about 8 Hz.

29. The mobile rail grinding machine of claim 3, wherein at least three of said rail grinding tools are mounted, on the tool carrier frame the two rail grinding tools at respective ends of the tool carrier frame being rigidly connected thereto while any one of the tools intermediate the end tools is vertically yieldably connected to the tool carrier frame.

30. The mobile rail grinding machine of claim 29, wherein the rail grinding tools are elongated whetstones.

31. A mobile rail grinding machine for continuously grinding irregularities off surface areas of track rails while the machine advances continuously along the track, which comprises (a) a machine frame,
(b) undercarriages mounting the machine frame on the track rails,
(c) means for continuously moving the machine frame on the undercarriages in the direction of, and along, the track,
(d) a tool carrier frame,
(e) a group of rail grinding tools mounted on the tool carrier frame successively in the track direction, the tools being adapted to grind the surface irregularities when pressed against the rails,
(f) means for vertically adjustably mounting the tool carrier frame on the machine frame and for pressing the tools against the srface areas of the rails to be ground, and
(g) a drive connected to the tool carrier frame and operating independently of the means for continuously moving the machine frame for imparting to the tool carrier frame a reciprocatory working movement in the track direction additional to the movement simultaneously imparted to it by the continuous movement of the machine frame, the drive comprising
  (1) a drive mechanism,
  (2) a push-and-pull connecting element linking the carrier frame to the drive mechanism,
  (3) respective pivotal connections linking the connecting element to the carrier frame and the drive mechanism, the connecting element having a point of articulation between the pivotal connections, and
  (4) a guide member extending substantially parallel to the plane of the track and glidingly holding the point of articulation of the connecting element, the guide member and the pivotal connection to the carrier having about the same distance from the plane of the track.

32. The mobile rail grinding machine of claim 31, further comprising means for varying the distance of the guide member from the track plane.

33. A mobile rail grinding machine for continuously grinding irregularities off surface areas of track rails while the machine advances continuously along the track, which comprises (a) a machine frame,
(b) undercarriages mounting the machine frame on the track rails,
(c) means for continuously moving the machine frame on the undercarriages in the direction of, and along, the track,
(d) a tool carrier frame associated with each of the rails and mounted symmetrically with respect to a central plane of symmetry,
(e) two cylinder-and-piston devices interconnecting the two tool carrier frames for lateral adjustment with respect to each other, (f) a group of rail grinding tools mounted on each of the tool carrier frames, each of the tools being adapted to grind irregularities off surface areas of the rails when pressed thereagainst in a direction vertical to the machine frame, (g) means for vertically adjusting the tools for pressing the tools against surface areas of the rails to be ground, and (h) a drive connected to the tool carrier frame and operating independently of the means for continuously moving the machine frame for imparting to the tool carrier frame a reciprocatory working movement in the track direction additional to the movement simultaneously imparted to it by the continuous movement of the machine frame, the drive comprising (1) a drive mechanism and (2) a push-and-pull connecting element linking each carrier frame to the drive mechanism, respective pivotal connections linking the connecting element to the carrier frame and to the drive mechanism, the pivotal connections having about the same distance from the plane of the track and at least a portion of the connecting element adjacent the tool carrier frame extending in a plane extending perpendicularly to the track plane and defined by the working movement.

* * * * *